US005273210A

United States Patent [19]

Pender et al.

[11] Patent Number: 5,273,210

[45] Date of Patent: Dec. 28, 1993

[54] ROOM HEATING ARRANGEMENT

[75] Inventors: Veit Pender, Ladenburg; Josef Jendrisâk, Mannheim, both of Fed. Rep. of Germany

[73] Assignee: Pender Strahlungsheizung GmbH, Fed. Rep. of Germany

[21] Appl. No.: 848,348

[22] Filed: Mar. 9, 1992

[30] Foreign Application Priority Data

Mar. 15, 1991 [DE] Fed. Rep. of Germany ... 9103004[U]

[51] Int. Cl.[5] ..... F24D 5/00

[52] U.S. Cl. ..... 237/53; 126/110 C; 126/110 D

[58] Field of Search ..... 237/70, 12.3 C; 126/92 AC, 92 B, 110 C, 110 D; 431/353

[56] References Cited

U.S. PATENT DOCUMENTS 4,390,125 6/1983 Rozzi ..... 237/70

*Primary Examiner*—Henry A. Bennett

*Attorney, Agent, or Firm*—Kinzer, Plyer, Dorn, McEachran & Jambor

[57] ABSTRACT

The room heating arrangement is provided with a radiation tube, connected to a pressure and mixing chamber casing 1, a pipe line system arranged above the room to be heated, the radiation tube being connected, on the one hand, to a return flow chamber 19 with fan 10 and, on the other hand, to a mixing chamber 20 with a flame tube 14 surrounding a burner 2. The pressure and mixing chamber casing 1 is constructed in double-worm form, two cylindrical parts 26, 27 forming the casing and a front and back plate 3, 4 presenting the double-worm form, while the connecting tubes 18, 21 for the radiation tube are connected to the back plate 4. The burner 2 and the drive unit 5 for the fan 10 are arranged on the front plate 3.

12 Claims, 7 Drawing Sheets

ROOM HEATING ARRANGEMENT

The invention relates to a room heating arrangement with a radiation tube, connected to a mixing chamber casing, of a pipe line system arranged above the room to be heated, in which the radiation tube is conneced, on the one hand, to a return flow chamber with fan and, on the other hand, to a mixing chamber with a flame tube surrounding a burner.

There is known such a room heating arrangement, in which the radiation tube is connected to a pressure and mixing chamber casing. By reason of the construction of this casing and also the arrangement of the fan in this casing there is yielded a relatively large structural form, which, moreover, is unfavorable for the flow.

Underlying the invention is the problem of constructing such an arrangement in such a way that the turbulence zone in the mixing chamber casing is formed so that a hot core zone in the zone of the burner is surrounded by a cooler air layer of the back-flowing gas, in order to achieve the result that over a large interval there is brought about a uniform heat delivery in the radiation tube.

This problem is solved according to the invention by the means that the mixing chamber casing is constructed in double-worm form, two cylindrical parts forming the casing and a front and back plate having the double-worm form, while the connecting tubes for the radiation tube are connected to the back plate.

An advantageous form of execution consists in that between the return-flow chamber and the mixing chamber there is arranged a regulating damper.

Further it is advantageous that the flame tube has bores toward the front plate.

It is further proposed that the drive shaft of the fan is shifted with respect to the opening for the drive unit to the right to the mixing chamber, or coincides with the axis of the connecting tube for the radiation tube return flow.

It is advantageous that the casing is supported on rectangular tubular frames, in which the upper corners are beveled.

It is further proposed that the drive for the fan impeller with motor and bearing block is flanged as a drive unit on the front plate of the casing.

Advantageously there on the front plate on the fan shaft there is provided a cooling blower with passage bores.

It is advantageous that the turning rate of the fan impeller is adjustable.

Further it is proposed that the chimney connection be mountable on the casing on both sides.

An advantageous form of execution provides that at the end of the flame tube measuring nipples are provided for the amount of exhaust gas, the measuring nipples being connected to a line that is led out of the pressure and mixing chamber casing.

Further, the procedure is such that at the end of the mixing chamber there are arranged a pressure switch and measuring points for temperature sensors.

It is proposed that in the chimney connection there be present a heat exchanger for the room fresh air preheating.

It is proposed, furthermore, that a heat exchanger be arranged in the forward or return flow of the radiation system or in a bypass line which serves for the warming of the air.

Finally, it is advantageous that the drive energy for the air preheating is recovered from the pressure-side excess energy at the regulating damper, for example by means of a fan blade or the like.

The invention offers the substantial advantage that a specially constructed double-worm casing is provided, so that there is achieved a favorable turbulence of the flowing medium and thereby a better heat transition. Furthermore, there is yielded thereby a lower noise level. Through the asymmetrical arrangement of the drive shaft of the fan, the structural size can be reduced. The variable speed provided of the fan brings about an adaptation of the amount of air and of the pressure relations to different radiation tube lengths. Here, the adjustment of the combustion chamber to pressureless state of subpressure operation in the heat radiation tube can be made. Through the apparatus suspension provided the arrangement can be suspended directly under the ceiling, so that little space is needed for the installation.

The invention is explained in the following specification with the aid of examples of execution represented in the drawings.

Figure 1:
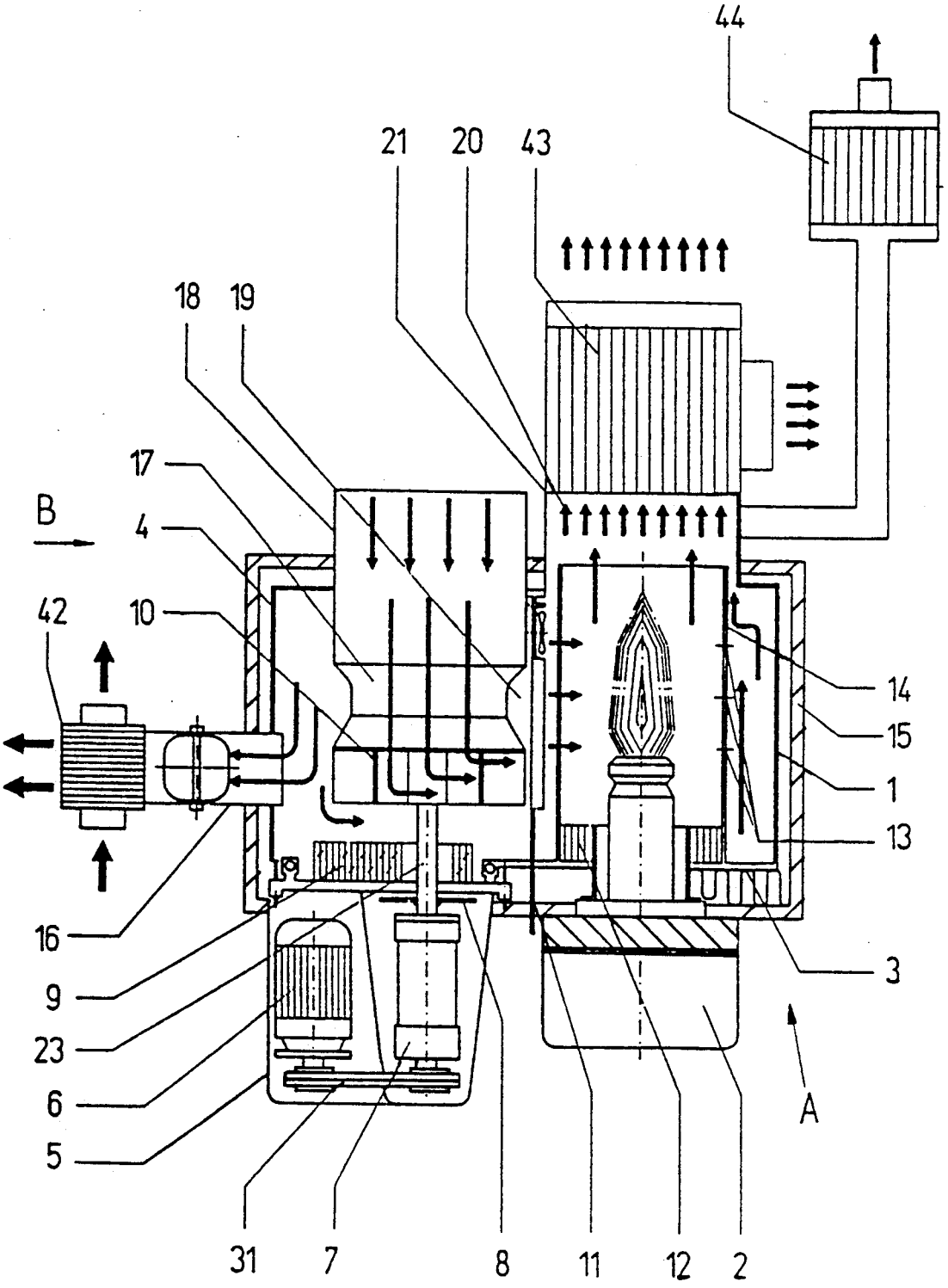
FIG. 1 shows a plan view of such a room heating arrangement.
Figure 2:
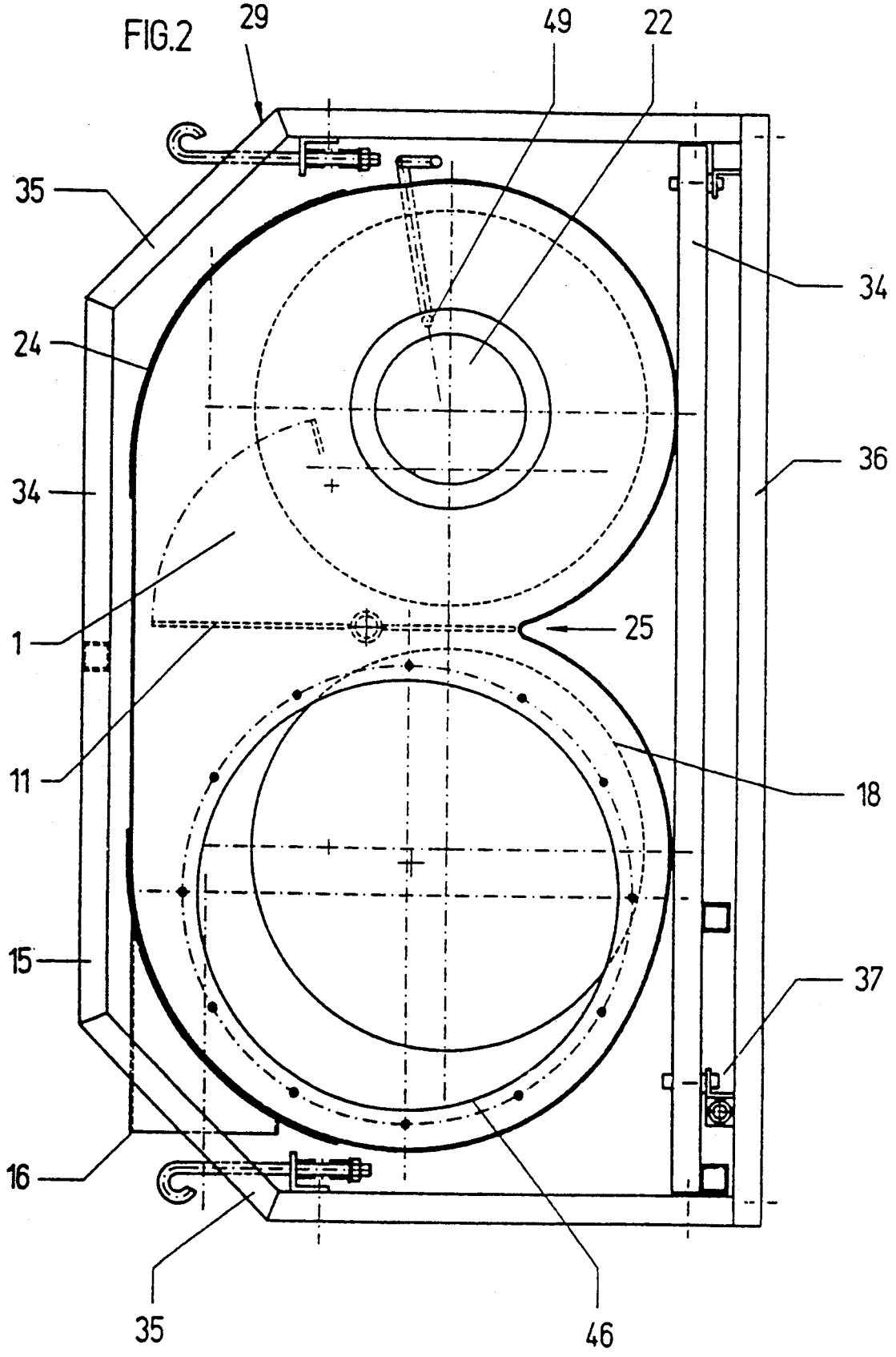
FIG. 2 shows a view in arrow direction A according to FIG. 1.
Figure 3:
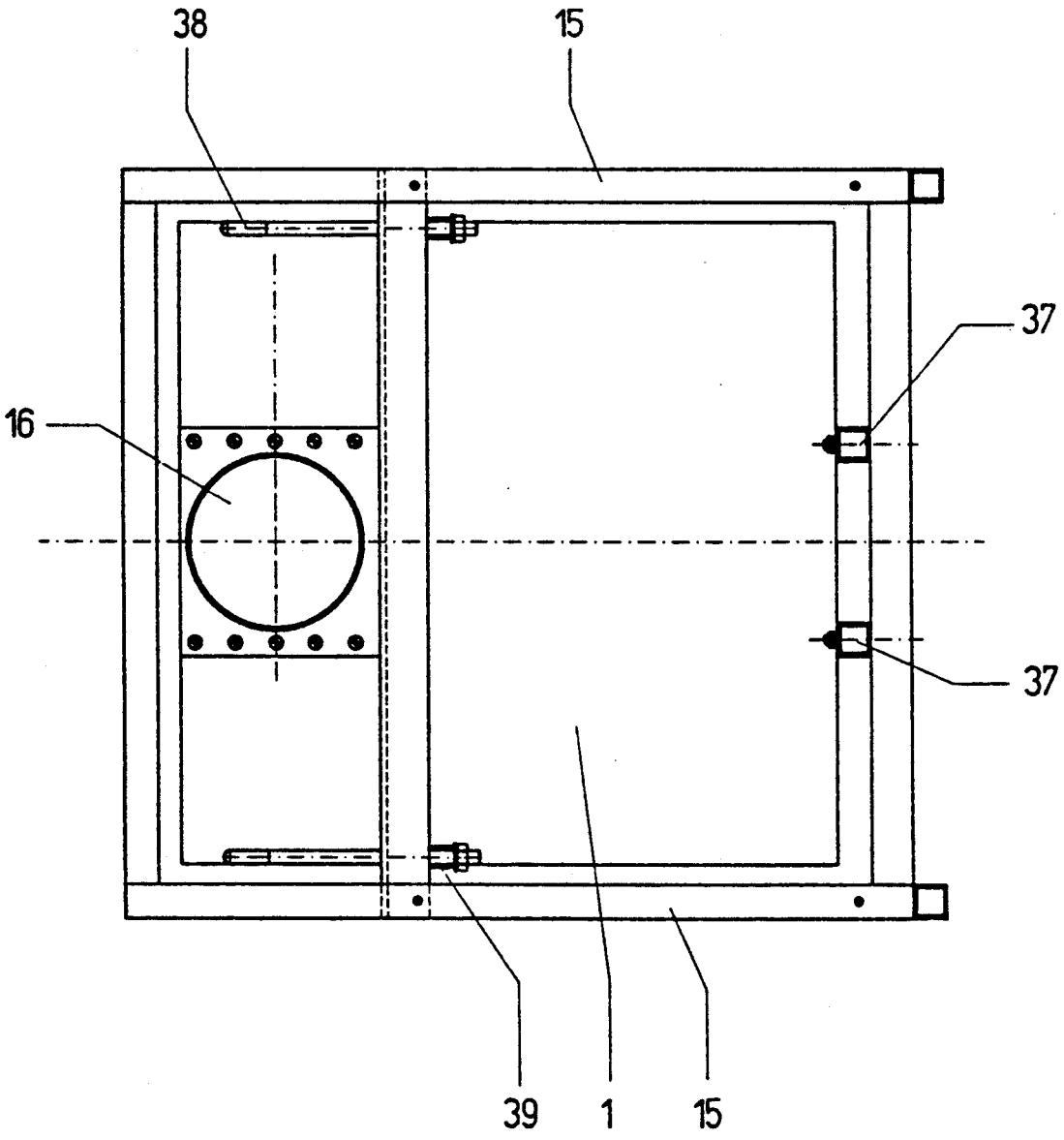
FIG. 3 shows a view in arrow direction B according to FIG. 1.

The room heating arrangement represented in FIGS. 1 to 3 presents a specially shaped mixing chamber casing 1, which is divided about in the middle by a regulating damper 11. On the one side of the casing 1 there is present the fan with an impeller 10, the inflow nozzle 17 and the connecting tube 18 for the return flow of the radiation tube (not shown) with its return flow chamber 19. The tube 18 here enters the casing 1 at the back plate 4. The drive shaft 23 of the fan is shifted with respect to the opening 46 for the drive unit 5 to the right to the mixing chamber 20, or coincides with the axis of the connecting tube 18 for the radiation tube return flow and is led out of the casing 1 on the front plate 3. This drive unit 5 consists of a drive 6 with a V-belt drive 31, which is constructed for the power adaptation in such a way that the V-belts can be exchanged for four power stages. The fan shaft 23 is borne on a bearing block 7, a cooling blower being provided between the front plate 3 and the bearing block 7. On the inside of the casing there is present a thermal insulation 9 opposite the drive unit 5.

On the other side of the casing 1 there is located the burner 2, which extends into a flame tube 14, there being provided a ceramic insulation 12 inside the flame tube 14 toward the front plate 3. Onto the back plate 4 there is flanged the connecting tube 21 as the hot gas lead-in for the radiation tube and it contains the mixing chamber 20. Further, near the front plate 3 in the flame tube 14, there are located bores 13 which bring about a cooling of the flame and thereby minimize the nitric oxide formation. Also there is present on the fan side a chimney connection 16. Furthermore there are provided on the casing, frame constructions 15 which serve for the suspension of the apparatus.

At the end of the flame tube 14 there are present measuring nipples 49 for the exhaust gas, whereby there is made possible an exact measurement of the combustion values. These measuring nipples 49 are connected to a line which is led out from the mixing chamber casing 1. Further, at the end of the mixing chamber 20 there are provided measuring points for temperature sensors, so that an accurate measurement and a protection against overheating is possible.

For the optimal utilization of the thermal energy there can be provided various heat exchangers 42, 43 and 44. Thus, a first heat exchanger 42 is connected at the end of the chimney connection 16, which can serve both for the room fresh air preheating and also for the preheating of the combustion air for the burner. For example, an air stream passes out of the casing 1 and through the chimney connection 16, as shown by the arrows in FIG. 1. This air stream is preheated by virtue of passing through the inside of casing 1, which because of the enclosure provided by the casing and back plate 4 and the presence of the burner 2 within that enclosure, preheats the air stream before it exits out of the chimney connection 16. At the heat exchanger 42, a room fresh air inflow, shown by an arrow, permits fresh room air to mix with the air stream from the chimney connection 16, thereby outgassing preheated room fresh air and combustion air for the burner, as shown by the arrows in FIG. 1.

An additional heat exchanger 43 is arranged on the connecting tube 21 for the radiation tube lead-in or an additional heat exchanger 44 is arranged in a bypass line to the connecting tube 21. The thermal energy recovered here can be used for fresh air heating, for example for the heating of side rooms.

Figure 4:
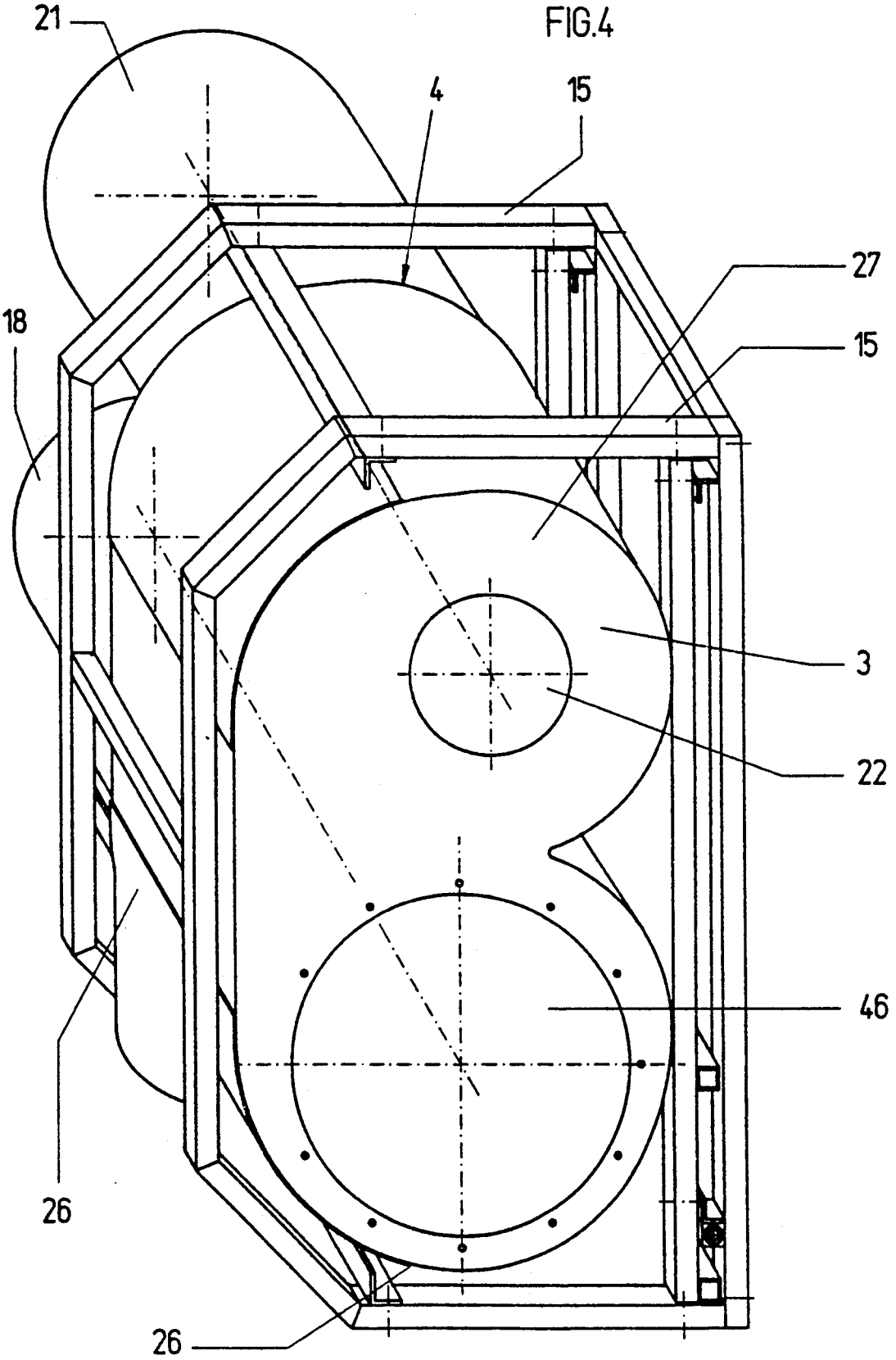
FIG. 4 shows a perspective view of the mixing chamber casing with the frames for securing to the ceiling.
Figure 5:
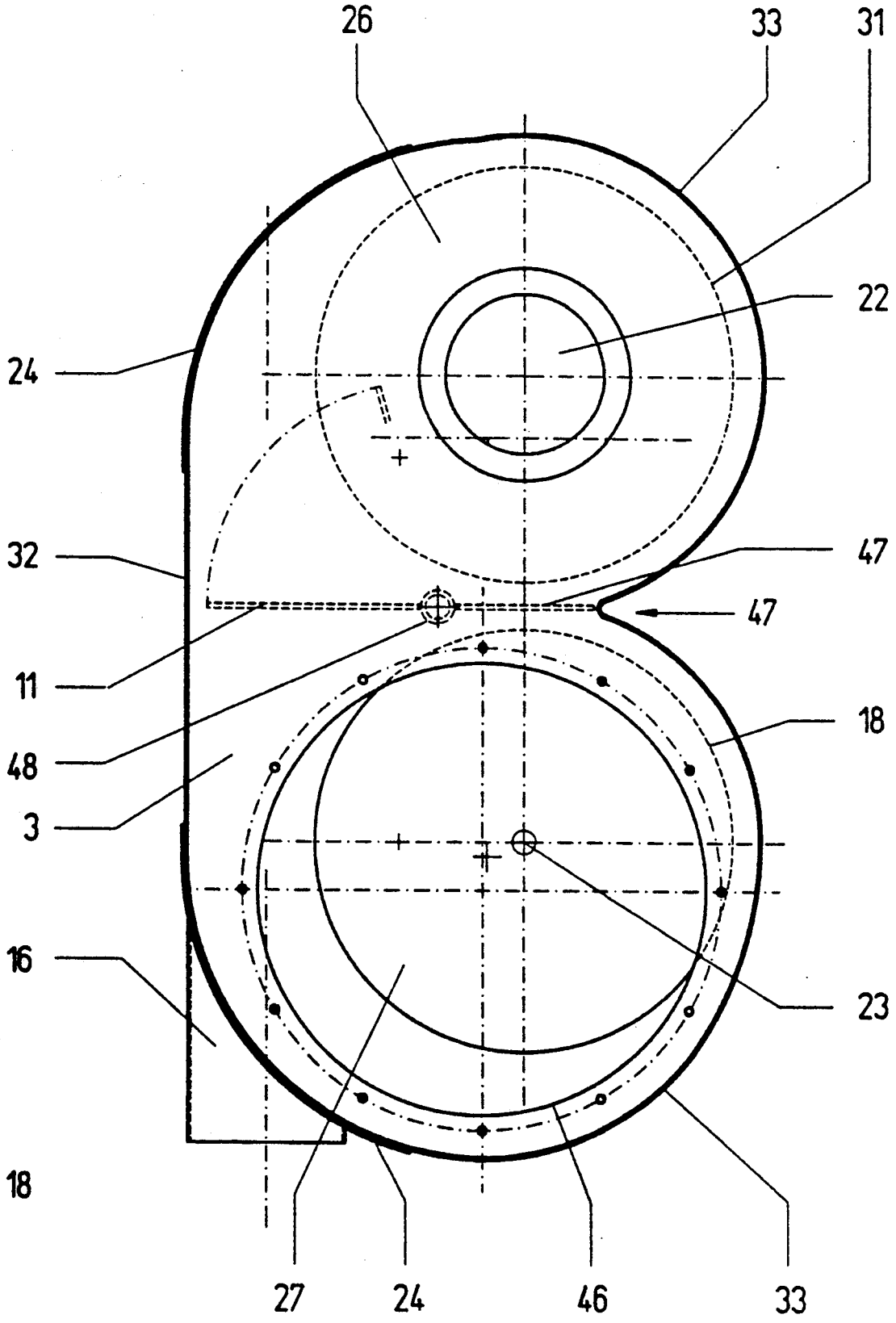
FIG. 5 shows a view of the front plate of the mixing chamber casing.

In FIG. 4 there is represented in perspective the casing 1, this casing consisting essentially of two cylindrical parts 26, 27 and these cylindrical parts receive, on the one hand, the burner part and, on the other hand, the fan part. By reason of the special form of this casing 1 there is yielded a great heat performance with small dimensions of the apparatus, especially through the especially flow-favoring construction of the casing. This form shows the front plate according to FIG. 5 with the opening 46 for the drive unit 5 and the opening 22 for the burner connections, the two parts 26, 27 being joined rectilinearly on the upper edge and being conducted from this rectilinear section in a spiral section to a constriction 25 provided about in the middle, the two halves being divided by the regulating damper 11 and a blocking plate 47 proceeding from the axis of rotation 48. In FIG. 5 there is visible the asymmetrical arrangement of the drive shaft 23 on the fan. At the transition of the rectilinear section 32 into the spiral section there can be mounted the chimney connection 16, in which a corresponding opening is closable by a cover plate 24, so that the chimney connection 16 can be provided on the left or on the right over prefabricated connecting pieces in the apparatus. Through this casing form there is yielded a favorable turbulence of the flowing medium and therewith also an especially good heat transition. Through the special form of the casing 1 there is yielded a turbulence zone such that the hot core zone of the burner is surrounded by a cooler air layer of the cooler-return or back-flowing gas. It is herewith achieved that over a great interval there is brought about a uniform delivery of heat in the radiation tube.

Figure 6:
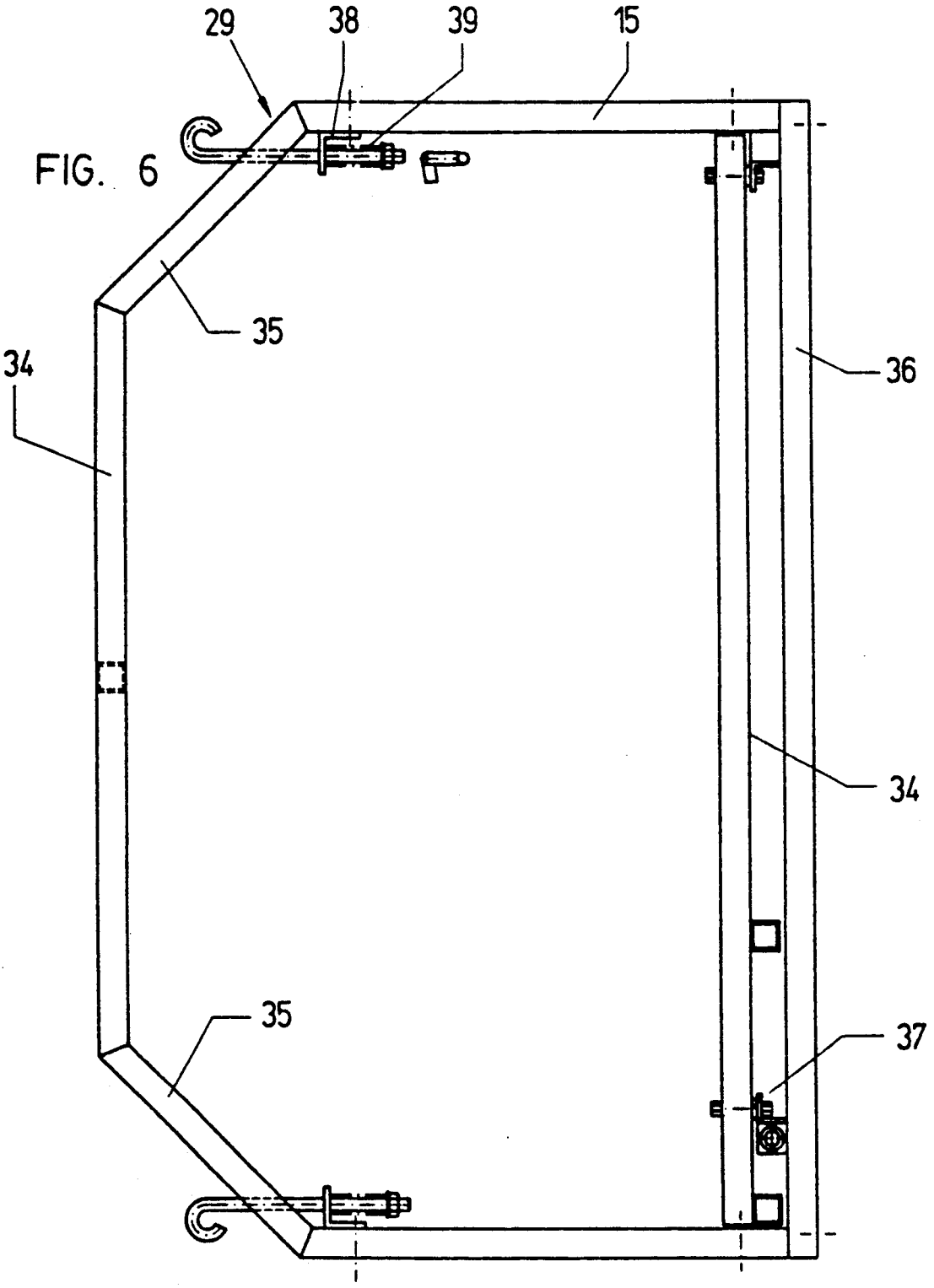
FIG. 6 shows a view of the frame of the apparatus suspension and FIGS. 7 and 8 show a representation of the cooling blower in section and in a plan view.

In FIG. 6 there is represented a frame 15 for the suspension of the apparatus. This frame consist of individual rectangularly assembled steel pipes 34, the upper corners 29 being formed by obliquely running tubes 35. The frame 15 is supported opposite a bottom-side carrier 36 on lateral shock absorbers 37. Further there are present in the zone of the obliquely running tubes 35 lash plates 38 which are provided for the apparatus suspension, i.e. for suspension on the ceiling with vibration dampers 39.

Figure 8:
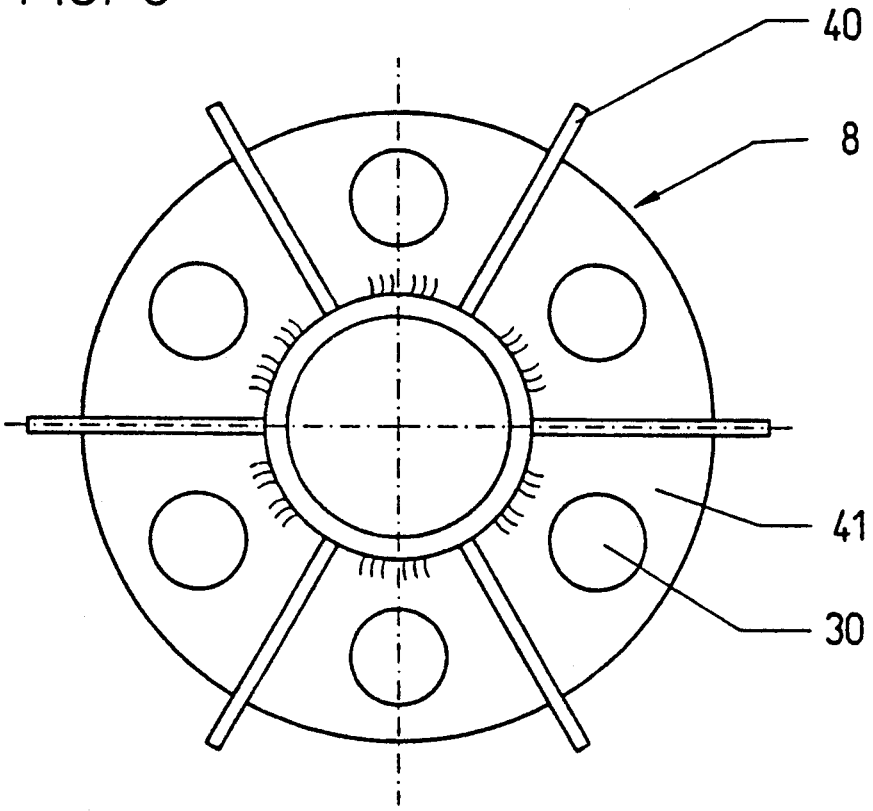
Figure 7:
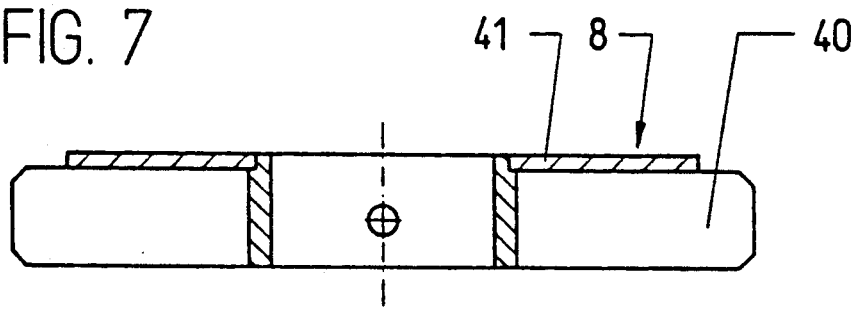

The cooling blower 8 represented in FIGS. 7 and 8 has individual ventilator blades 40, passage bores 30 being provided in a radially running flange 41 in order to avoid a heat storage.

We claim:

1. Room heating arrangement with a mixing chamber casing defining a mixing chamber (20), another chamber (19) with fan impeller and drive shaft and a combustion chamber provided with a flame tube (14) surrounding a burner, characterized in that the mixing chamber casing (1) is constructed in double-worm form with two cylindrical parts (26, 27) forming the casing (1) and a front and back plate (3, 4) presenting the double-worm form, and a connecting tube 18 connected to the backplate (4) and entering said chamber (19).

2. Room heating arrangement according to claim 1, characterized in that between the chamber (19) and the mixing chamber (20) there is arranged a regulating damper (11).

3. Room heating arrangement according to claim 1, characterized in that the flame tube (14) presents bores (13) toward the front plate (3).

4. Room heating arrangement according to claim 1, characterized in that the drive shaft (23) of the fan is shifted with respect to an opening (46) for a fan drive unit (5) to the right to the mixing chamber (20), or coincides with the axis of a connecting tube (18) for the radiation tube return flow.

5. Room heating arrangement according to claim 1, characterized in that the casing (1) is supported on rectangular tubular frames (15), in which the upper corners (29) are beveled.

6. Room heating arrangement according to claim 1, characterized in that as the drive for the fan impeller (10) there is motor (6) and bearing block (7) as drive unit (5) flanged on the front plate (3) of the casing (1).

7. Room heating arrangement according to claim 6, characterized in that on the front plate (3) a cooling blower (8) with passage bores (30) is provided.

8. Room heating arrangement according to claim 7, characterized in that the turning speed of the fan impeller (10) is adjustable.

9. Room heating arrangement according to claim 1, characterized in that a chimney connection (16) is mountable on both sides on the casing (1).

10. Room heating arrangement according to claim 1, characterized in that at the end of the flame tube (14) measuring nipples (49) are provided for the exhaust gas amount, the measuring nipples (49) being connected to a line which is led out of the pressure and mixing chamber casing (1).

11. Room heating arrangement according to claim 1, characterized in that at the end of the mixing chamber (20) there are arranged a pressure switch and measuring points for temperature sensors.

12. Room heating arrangement according to claim 1, characterized in that the drive energy for the air preheating is recovered from the pressure-side excess energy at the regulating damper (11).

* * * * *